US005123684A

United States Patent [19]

Yeh

[11] Patent Number: 5,123,684

[45] Date of Patent: Jun. 23, 1992

[54] DOOR LOCK WITH INVERTABLE BOLT

[76] Inventor: Ming-Tien Yeh, No. 41, Lane 46, Kuang Hua Street, Changhua, Taiwan

[21] Appl. No.: 702,002

[22] Filed: May 17, 1991

[51] Int. Cl.[5] ..... F05B 15/04

[52] U.S. Cl. ..... 292/244; 292/337

[58] Field of Search ..... 292/244, 245, 337

[56] References Cited

U.S. PATENT DOCUMENTS

| | | | |
|---|---|---|---|
| 2,424,450 | 7/1947 | Ghia | 292/244 |
| 2,803,481 | 8/1957 | Williams et al. | 292/245 |
| 3,361,462 | 1/1968 | Foster | 292/245 |
| 3,361,464 | 1/1968 | Foster | 292/245 |
| 4,875,725 | 10/1989 | Marks | 292/244 |
| 4,958,866 | 9/1990 | Larsson | 292/245 |
| 4,988,133 | 1/1991 | Shih | 292/244 |

FOREIGN PATENT DOCUMENTS

| | | | |
|---|---|---|---|
| 499378 | 1/1954 | Canada | 292/244 |
| 2827939 | 1/1980 | Fed. Rep. of Germany | 292/244 |
| 49103 | 8/1940 | Netherlands | 292/244 |

*Primary Examiner*—Eric K. Nicholson
*Attorney, Agent, or Firm*—Bacon & Thomas

[57] ABSTRACT

A door lock, comprising a bolt assembly movably retained by a stop member in a slideway inside a lock case, which stop member is retained by a torsional spring and confined by an adjusting screw for rotation through a fixed angle. Loosening the adjusting screw causes the bolt assembly to be released from the stop member permitting it to be changed upside down. The bolt assembly comprises a sector-like bolt detechably secured to a bolt holder by a screw. The sector-like bolt can be inverted and then reattached to the bolt holder.

1 Claim, 4 Drawing Sheets

DOOR LOCK WITH INVERTABLE BOLT

BACKGROUND OF THE INVENTION

1. Field of the Invention

The present invention is related to door locks and relates more particularly to a door lock in which the bolt can be turned upside down so as to fit the swinging direction of the door to be fastened.

2. Description of the Prior Art

Regular door locks are generally comprised of a bolt incorporated in a lock case, which bolt can be moved by a key or knob to insert in or release from a striking plate so as to fasten or unfasten a door or window. Because the bolt of a door lock generally has a flat bottom surface and a curved top surface, the position of the bolt must be correctly set while mounting a door lock on a door panel. Because the position of the bolt in a lock case is not changeable, a door lock will become useless if it is mounted on a door panel in a wrong direction (in general condition, the flat bottom surface of the bolt must by disposed at the outside and the curved top surface thereof must be disposed at the inside when a door lock is mounted on a door panel).

SUMMARY OF THE INVENTION

The present invention has been accomplished under the circumstances in view. It is therefore the main object of the present invention to provide a door lock which can be conveniently adjusted to fit the swinging direction of a door to be fastened.

According to one aspect of the present invention, there is provided a door lock which comprises a bolt holder movably retained by a stop member in a slideway inside a lock case to hold a bolt, wherein said bolt can be detached from said bolt holder and turned upside down and then attached to said bolt holder again.

According to another aspect of the present invention, the stop member is retained by a torsional spring and confined by an adjusting screw to rotate through a fixed angle, wherein loosening the adjusting screw causes the bolt holder and the bolt to be released from the stop member for position change.

According to still another object of the present invention, the lock case has a pin projection in the slideway at one end for holding a compression spring which has an end stopped against the bolt holder to keep it sliding stably.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENTS

Figure 1:
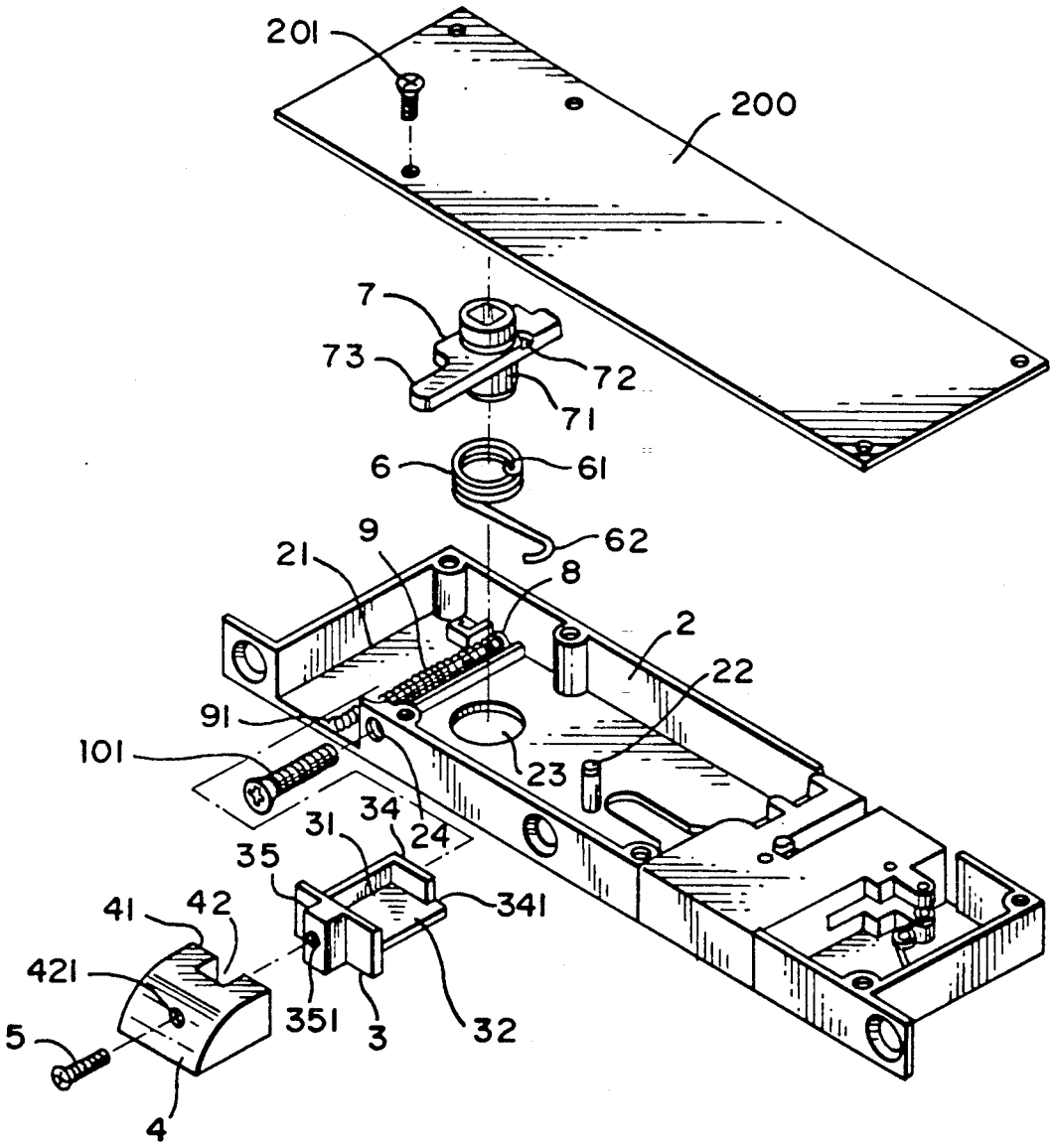
FIG. 1 is a dismantled view of the preferred embodiment of the door lock of the present invention.
Figure 2:
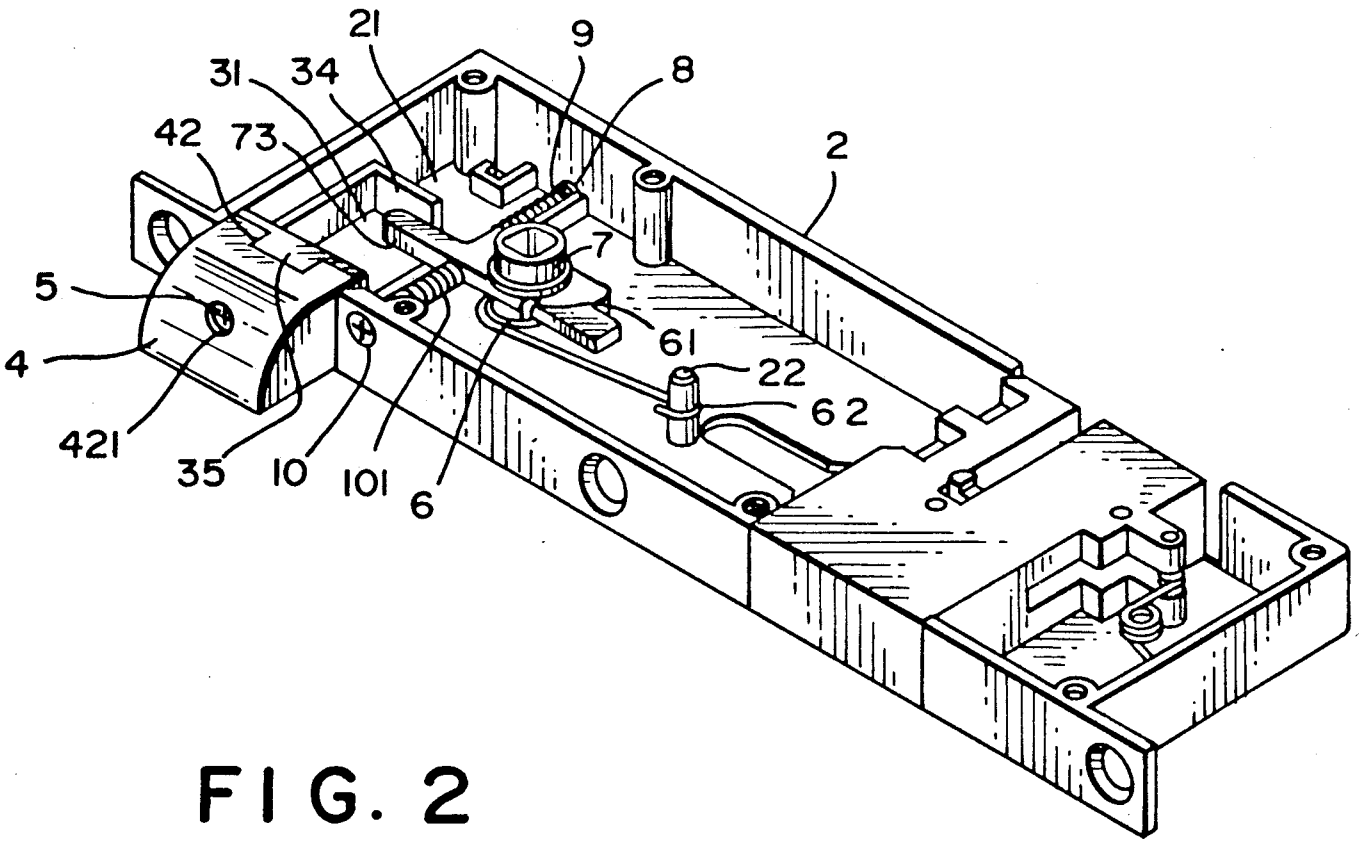
FIG. 2 is a perspective assembly view thereof.

Referring to FIGS. 1 and 2, a door lock in accordance with the present invention is generally comprised of a lock case 2, a bolt holder 3, a bolt 4, a fastening screw 5, a torsional spring 6, a stop member 7, a pin 8, a compression spring and an adjusting screw 10. The lock case 2 is provided with a cover 2000 which is detachably secured to case 2 by a plurality of screws 201, one which being depicted in FIG. 1. The lock case 2 has a slideway 21 for the bolt holder 3 and the bolt 4, a through-hole slidably receiving 23 for mounting the stop member 7 which is driven to rotate by a knob, a column 22 for holding the torsional spring 6 in place, and a bolt hole 24 on the front face thereof adjacent to said slideway 21 for mounting the adjusting screw 10. The bolt holder 3 has a rectangular block 35 at the front of the body thereof, which rectangular block 35 has a bolt hole 351 at the center, and two L-shaped bumper walls 34 extending outwardly from said body on two opposite sides thereof, with only one wall 84 being depicted in FIG. 1. Each L-shaped bumper wall 34 defines with the body of the bolt holder 3 a surrounded chamber 31 at one side and an open chamber 33 at an opposite side, which surrounded chamber 31 has an opening 32 at one side and a passage way 341 at one corner. The bolt 4 is of a sector-like configuration, having a flat surface 44 at the bottom, a circular surface 43 at the top, a vertical surface 41 at the back, a notch 42 on said vertical surface 41 for mounting the rectangular block 35, a bolt hole 421 through said curved surface 43 and said notch 42. The bolt holes 421 and 351 are longitudinally aligned once the rectangular block 35 of the bolt holder 3 is inserted in the notch 42 on the vertical surface 41 of the bolt 4 and therefore, the fastening screw 5 can be fastened into the bolt holes 421 and 351 to firmly secure the bolt 4 to the bolt holder. The pin 8 is fastened in the lock case 2 and disposed to project into the slideway 21. The compression spring 9 is sleeved on the pin 8, having one end secured to the pin 8 and an opposite end abutting against the bolt holder 3 at edge 36. The stop member 7 comprises a shaft 71 inserted through the through-hole 23 on the lock case 2 to couple to a knob, and a unitary lever 73 projecting from said shaft 71 to retain the bolt holder 3 in place, which lever 73 has a retaining hole 72 at one end. Once the bolt holder 3 is inserted in the slideway 21 inside the lock case 2, the lever 73 of the stop member 7 extends through the passage way 341 and into the surrounded chamber 31 on the top of the body of the bolt holder 3 and then engage with the L-shaped bumper wall 34 which is disposed at the top. Therefore, the bolt holder 3 can be retained in the slideway 21 inside the lock case 2 by the stop member 7. The torsional spring 6 is mounted on the shaft 71 and retained between the lock case 2 and the stop member 7, having one end 61 fastened in the retaining hole 72 on the lever 71 and an opposite end secured to the column 22. The adjusting screw 10 has an outer thread portion 101 fastened in the bolt hole 24 on the front face of the lock case 2 and stopped against the lever 73 of the stop member 7 at one side.

Figure 3:
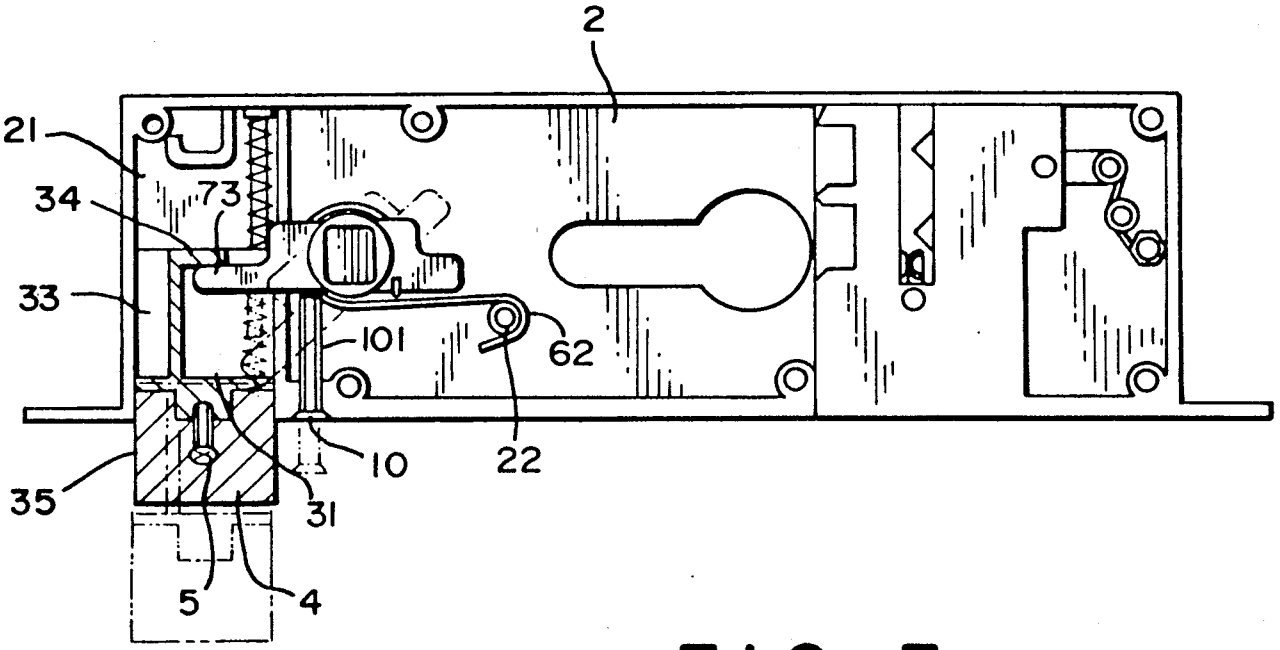
FIG. 3 illustrates that the lever of the stop member is rotated through a certain angle permitting the bolt holder and the bolt to be removed out of the lock case for changing the position when the adjusting screw is lossened.
Figure 3A:
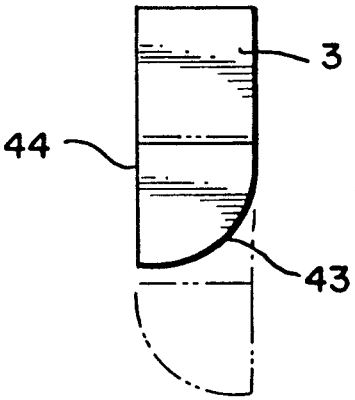
FIG. 3*a* illustrates a side view of the bolt and bolt holder as shown in FIG. 3.
Figure 4:
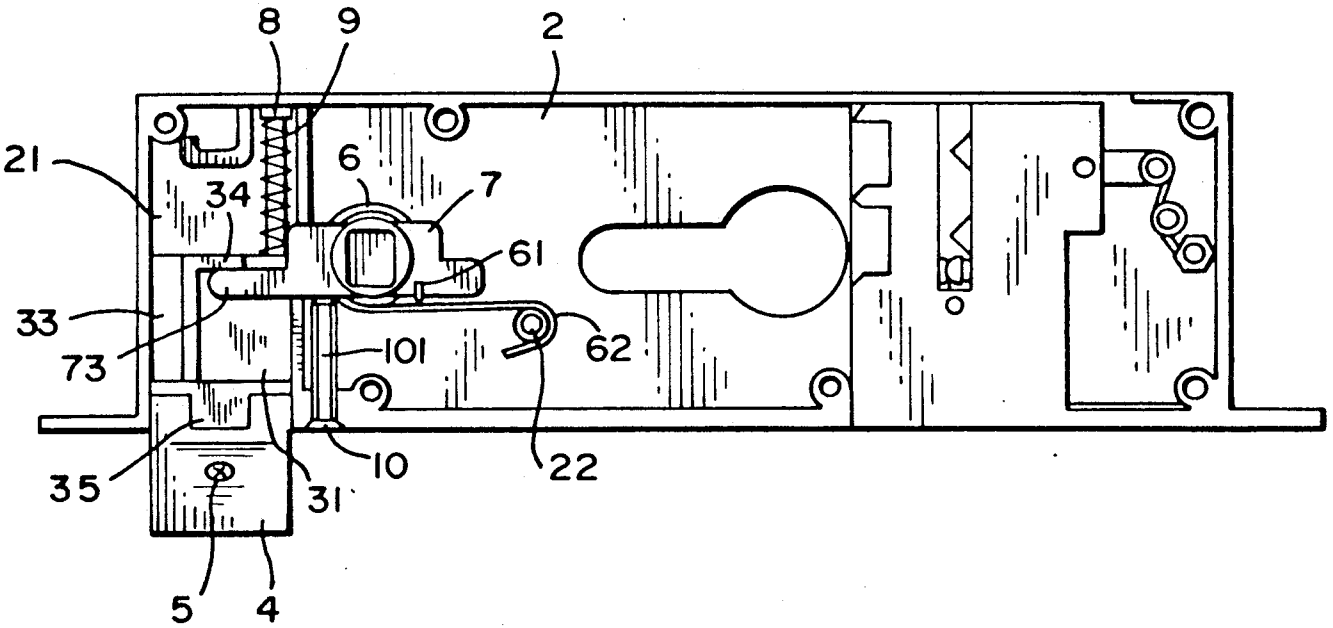
FIG. 4 illustrates that the bolt has been turned upside down, after having been detached from the bolt holder, and secured to the bolt holder again.
Figure 4A:
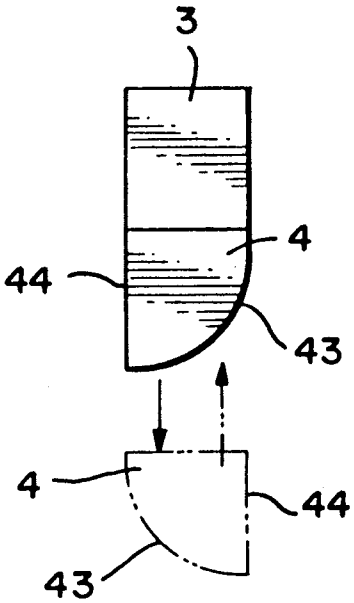
FIG. 4*a* illustrates a side view of the bolt and bolt holder as shown in FIG. 4.

Referring to FIGS. 3 and 4, the bolt 4 and the bolt holder 3 can be removed the lock case 2 for changing the position (the relative position of the curved surface and the flat surface in the slideway can be changed by inverting the bolt and the bolt holder). Loosening the adjusting screw 10 causes the torsional spring 6 to force the stop member 7 to rotate on the through-hole 23 through a certain angle into a position as shown in the dotted line in FIG. 3. Thus, the bolt holder 3 is released from the constraint of the lever 73 and permitted to be removed out of the lock case 2. Once the bolt 4 and the bolt holder 3 are inverted, they are inserted into the slideway 21 again. After passing through the lever 73, the adjusting screw 10 is fastened tightly again to move the lever 73 to stop against the L-shaped stop wall 34 on the top eedge of the bolt holder 3 to firmly retain the bolt holder 3 in the lock case 2. Further, the bolt 4 may be directly detached from the bolt holder for changing the position of the circular surface 43 thereof by removing the fastening screw 5 from the bolt 4. After having been turned upside down, the bolt 4 is attached to the bolt holder 3 again, and then, the fastening screw 5 is fastened through the bolt hole 421 on the bolt 4 into the bolt 351 on the bolt holder 3 to tightly secure the bolt 4 to the bolt holder 3.

I claim:

1. A lock for fastening a door comprising:

a) a lock case including a slideway at one end, a bottom, a column extending upwardly from the bottom, a through-hole in the bottom, the through-hole being positioned between the slideway and the column, a front face, and a first bolt hole provided on the front face adjacent the slideway;

b) a bolt holder including a flat base, a front block at a front of the flat base, the front block provided with a second bolt hole at a center thereof, two L-shaped bumper walls extending outwardly from two opposite sides of the flat base in opposite directions, each L-shaped bumper wall defining with the flat base a surrounded chamber at one side and an open chamber at an opposite side, the surrounded chamber having an opening at one side and a passageway at a corner thereof;

c) a bolt having a configuration defined by a flat bottom surface, a curved top surface, and a vertical back surface, a notch on the vertical back surface for receiving the front block of the bolt holder, a third bolt hole extending through the curved top surface and the notch, the third bolt hole being axially aligned with the second bolt hole on the front block for receiving a screw to secure the bolt to the bolt holder;

d) a pin disposed in the lock case and projecting into the slideway;

e) a compression spring including first and second ends, the first end being secured to the pin and the second end abutting against the bolt holder;

f) a stop member including a shaft, the shaft being disposed through the through-hole of the lock case for coupling to a knob and an unitary lever positioned vertically to the shaft, the lever being disposed in the surrounded chamber for abutting against one of the L-shaped bumper walls and limiting the moving range of the bolt holder and the slideway, the lever having a retaining hole at one end thereof;

g) a torsional spring mounted on the shaft and retained between the lock case and the stop member, the torsional spring including first and second ends, with the first end being fastened in the retaining hole on the lever and the second end being secured to the column;

h) an adjusting screw fastened in the first bolt hole on the front face of a lock case for abutting against the lever; and i) wherein the bolt may be detached from the bolt holder by removing the screw securing the bolt to the bolt holder to permit the bolt to be turned upside down and reattached to the bolt holder, and the bolt and bolt holder can both be removed from the lock case by loosening the adjusting screw to permit the bolt and bolt holder to be turned upside down and reinserted into the lock case and retained in the slideway by the stock member upon tightening of the adjusting screw.

* * * * *